US009581038B2

(12) United States Patent
Hillier et al.

(10) Patent No.: US 9,581,038 B2
(45) Date of Patent: Feb. 28, 2017

(54) SEAL SEGMENT

(71) Applicant: ROLLS-ROYCE PLC, London (GB)

(72) Inventors: Steven Hillier, Manchester (GB); Dennis Jong, Delft (NL)

(73) Assignee: ROLLS-ROYCE PLC, London (GB)

( * ) Notice: Subject to any disclaimer, the term of this patent is extended or adjusted under 35 U.S.C. 154(b) by 749 days.

(21) Appl. No.: 13/945,377

(22) Filed: Jul. 18, 2013

(65) Prior Publication Data

US 2014/0030072 A1 Jan. 30, 2014

(30) Foreign Application Priority Data

Jul. 24, 2012 (GB) ..... 1213109.0

(51) Int. Cl.
*F01D 11/00* (2006.01)
*F01D 11/12* (2006.01)
*F01D 25/00* (2006.01)

(52) U.S. Cl.
CPC ..... *F01D 11/006* (2013.01); *F01D 11/001* (2013.01); *F01D 11/122* (2013.01); *F01D 25/005* (2013.01); *F05D 2300/6033* (2013.01)

(58) Field of Classification Search
CPC ..... F01D 11/08; F01D 11/14; F01D 11/16; F01D 11/18; F01D 9/04; F01D 25/24; F01D 25/243; F01D 25/246; F01D 11/006; F01D 11/001; F01D 11/112; F01D 25/005
USPC ..... 415/173.1, 177, 213.1
See application file for complete search history.

(56) References Cited

U.S. PATENT DOCUMENTS 7,950,234 B2 * 5/2011 Radonovich ..... F01D 11/122 415/173.1
8,246,299 B2 * 8/2012 Razzell ..... F01D 11/005 415/116
2007/0031258 A1 2/2007 Campbell et al.
(Continued)

FOREIGN PATENT DOCUMENTS

EP 0 751 104 A2 1/1997
EP 1 965 030 A2 9/2008

OTHER PUBLICATIONS

British Search Report issued in Application No. 1213109.0; Dated Nov. 19, 2012.

*Primary Examiner* — Dwayne J White
*Assistant Examiner* — Su Htay
(74) *Attorney, Agent, or Firm* — Oliff PLC

(57) ABSTRACT

A seal segment is positioned, in use, radially adjacent the rotor. The seal segment has first and second circumferentially spaced passageways each of which extends in the fore and aft direction. In use, a first support bar is contained within the first passageway, and a second support bar is contained within the second passageway. The first and second support bars being mountable to complementary formations provided by the casing of the engine. The first passageway is configured such that the seal segment is fixed relative to the first support bar in the radial and circumferential directions. The second passageway is configured such that the seal segment is fixed relative to the second support bar in the radial direction but allows relative movement of the seal segment and the second support bar in the circumferential direction to accommodate differential thermal expansion of the seal segment and the casing.

15 Claims, 2 Drawing Sheets

(56) References Cited

U.S. PATENT DOCUMENTS

| | | | | |
|---|---|---|---|---|
| 2007/0077141 | A1* | 4/2007 | Keller | F01D 11/08 415/136 |
| 2008/0178465 | A1* | 7/2008 | Schiavo | F01D 25/246 29/889.21 |
| 2010/0069226 | A1* | 3/2010 | Meschter | C04B 35/117 501/134 |
| 2010/0183435 | A1* | 7/2010 | Campbell | F01D 5/189 415/209.3 |
| 2013/0119191 | A1* | 5/2013 | Wolfe | B29C 70/42 244/54 |
| 2013/0177408 | A1* | 7/2013 | Winn | F01D 9/041 415/201 |

* cited by examiner

SEAL SEGMENT

FIELD OF THE INVENTION

The present invention relates to a seal segment for a shroud ring of a rotor of a gas turbine engine, and particularly, but not exclusively, to such a segment which is formed of ceramic.

BACKGROUND OF THE INVENTION

The performance of gas turbine engines, whether measured in terms of efficiency or specific output, is improved by increasing the turbine gas temperature. It is therefore desirable to operate the turbines at the highest possible temperatures. For any engine cycle compression ratio or bypass ratio, increasing the turbine entry gas temperature produces more specific thrust (e.g. engine thrust per unit of air mass flow). However, as turbine entry temperatures increase, it is necessary to develop components and materials better able to withstand the increased temperatures.

This has led to the replacement of metallic shroud segments with ceramic matrix composite shroud segments having higher temperature capabilities. To accommodate the change in material, however, adaptations to the segments have been proposed. For example, EP 0751104 discloses a ceramic segment having an abradable seal which is suitable for use with nickel base turbine blades, and EP 1965030 discloses a hollow section ceramic seal segment.

A difficulty with ceramic shroud segments is their typically lower thermal expansion coefficient relative to the metallic parts of the engine. Differential thermal mismatches can make fixing of the segments to the engine problematic and can lead to unacceptable loadings on the segments.

A further difficulty, particularly with ceramic matrix composite shroud segments, is configuring the segments in a way that is compatible with composite forming techniques.

SUMMARY OF THE INVENTION

It would be desirable to provide a seal segment which can better accommodate differential thermal mismatches between the segment and other parts of the engine. It would also be desirable to provide a seal segment which is better adapted to be made from ceramic matrix composite.

Accordingly, in a first aspect, the present invention provides a seal segment for a shroud ring of a rotor of a gas turbine engine, the seal segment being positioned, in use, radially adjacent the rotor, wherein the seal segment has first and second circumferentially spaced passageways each of which extends in the fore and aft direction, such that, in use, a first support bar can be contained within the first passageway, and a second support bar can be contained within the second passageway, the first and second support bars being mountable to complementary formations provided by the casing of the engine, the first passageway being configured such that the seal segment is fixed relative to the first support bar in the radial and circumferential directions, and the second passageway being configured such that the seal segment is fixed relative to the second support bar in the radial direction but allows relative movement of the seal segment and the second support bar in the circumferential direction.

By allowing relative movement of the seal segment and the second support bar in the circumferential direction, differential thermal mismatch of the seal segment and the casing can be accommodated. The passageway and support bar approach to mounting the seal segment to the casing can also be compatible with a relatively simple, plate-like shape for the segment, which can be readily formed from ceramic matrix composite. However, the mounting approach can have broader applicability than just to segments formed from ceramic matrix composite or such shapes.

In a second aspect, the present invention provides a seal segment according to the first aspect and containing the first and second support bars in respectively the first and second passageways.

In a third aspect, the present invention provides a shroud ring of a rotor of a gas turbine engine, the shroud ring including an annular array of seal segments of the first or second aspect.

In a fourth aspect, the present invention provides a gas turbine engine having the shroud ring of the third aspect.

Optional features of the invention will now be set out. These are applicable singly or in any combination with any aspect of the invention.

Conveniently, the first and second support bars can each project from a front face and a rear face of the seal segment for mounting thereat to the complementary formations provided by the casing.

Typically, the complementary formations provided by the casing of the engine are formed by a backing plate of the shroud ring, although other arrangements for providing the formations may be may be adopted.

The seal segment may be formed of ceramic, and, in particular, may be formed of ceramic matrix composite. For example, the seal segment may be formed of continuous fibre reinforced ceramic matrix composite. In such a segment, the reinforcing fibres may be contained in layered plys which extend parallel to the radially inward facing surface of the seal segment.

The seal segment may have a substantially plate-like shape, i.e. with passageways in the form of through-holes extending in the plain of the plate. According to another option, the seal segment may have a "bath tub" shape, e.g. with a plate-like base portion radially adjacent the rotor and walls extending radially outwardly from the edges of the base portion. The front and rear walls can then provide the front and rear faces of the seal segment, and each passageway can be formed by a pair of aligned through-holes in respectively the front and rear walls. Other configurations for the seal segment are also possible.

An abradable ceramic coating can form the radially inward facing surface of the seal segment. For example, the coating may comprise hollow ceramic spheres in a ceramic matrix, e.g. as disclosed in EP 0751104.

The first and second support bars may be circular cross-section, cylindrical rods. The first passageway may then have a correspondingly circular cross-section. However, the second passageway may have a racetrack-shaped cross-section which allows the relative movement of the seal segment and the second support bar in the circumferential direction.

The support bars may be metallic. Typically, therefore, the support bars have a higher coefficient of thermal expansion than the seal segment. Thus the support bars may be a clearance fit in the passageways when cold, transitioning to a light interference fit in the passageways when at operating temperature.

The seal segment may further have circumferentially opposing side faces, each side face providing a respective slot which extends in the fore and aft direction and which, in the shroud ring, contains a respective strip seal for sealing the seal segment to a circumferentially adjacent seal segment.

Further optional features of the invention are set out below.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
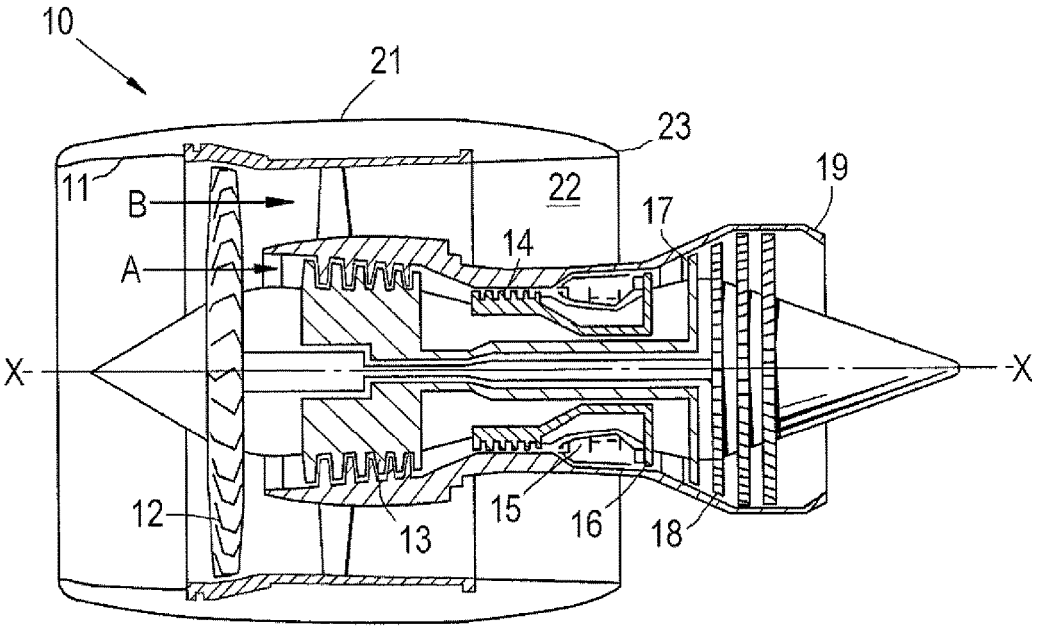
FIG. 1 shows a longitudinal sectional elevation through a ducted fan gas turbine engine.

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Figure 2:
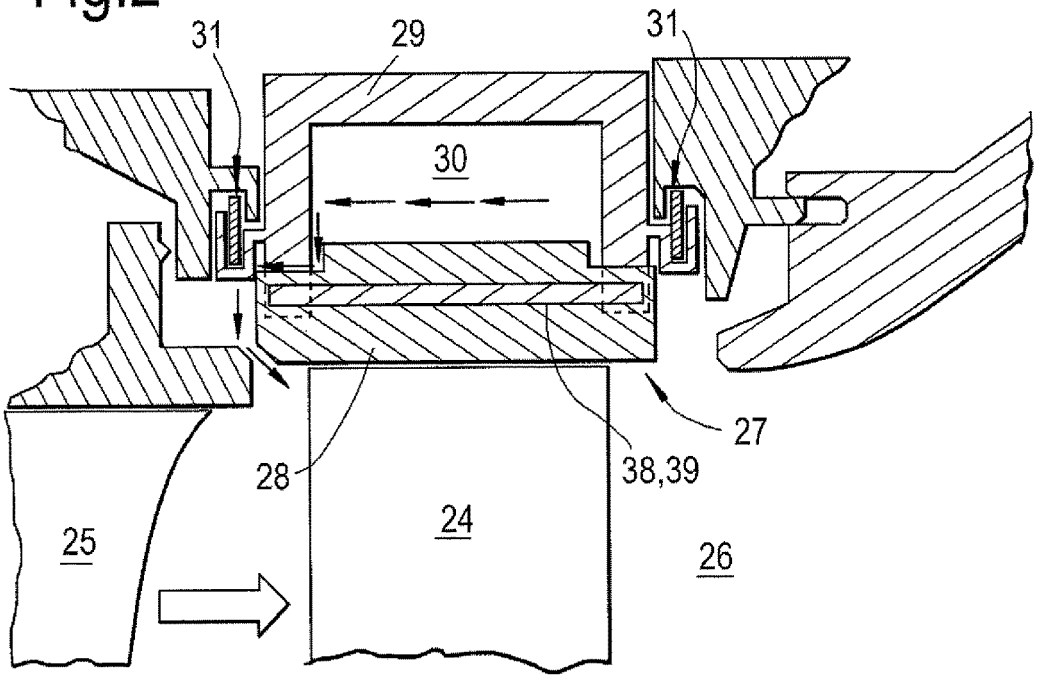
FIG. 2 shows schematically a sectional elevation through a portion of the high pressure turbine of the engine of FIG. 1.

The high pressure turbine 16 includes an annular array of radially extending rotor aerofoil blades 24, the radially outer part of one of which can be seen if reference is now made to FIG. 2, which shows schematically a sectional elevation through a portion of the high pressure turbine. Hot turbine gases flow over nozzle guide vanes 25 and the aerofoil blades 24 in the direction generally indicated by the large arrow. A shroud ring 27 in accordance with the present invention is positioned radially outwardly of the shroudless aerofoil blades 24. The shroud ring 27 serves to define the radially outer extent of a short length of the gas passage 26 through the high pressure turbine 16.

The turbine gases flowing over the radially inward facing surface of the shroud ring 27 are at extremely high temperatures. Consequently, at least that portion of the ring 27 must be constructed from a material which is capable of withstanding those temperatures whilst maintaining its structural integrity. Ceramic materials are particularly well suited to this sort of application.

The shroud ring 27 is formed from an annular array of seal segments 28 attached to a part of the engine casing which takes the form of an annular, metallic backing plate 29 having radially inwardly projecting, front and rear flanges. Cooling air for the ring 27 enters a space 30 formed between the backing plate 29 and the ring 27, the air being continuously replenished as it leaks, as indicated by the small arrows, under a pressure gradient, into the working gas annulus. The backing plate 29 is sealed at its front and rear sides to adjacent parts of the engine casing by piston ring-type sealing formations 31 of conventional design.

Figure 3:
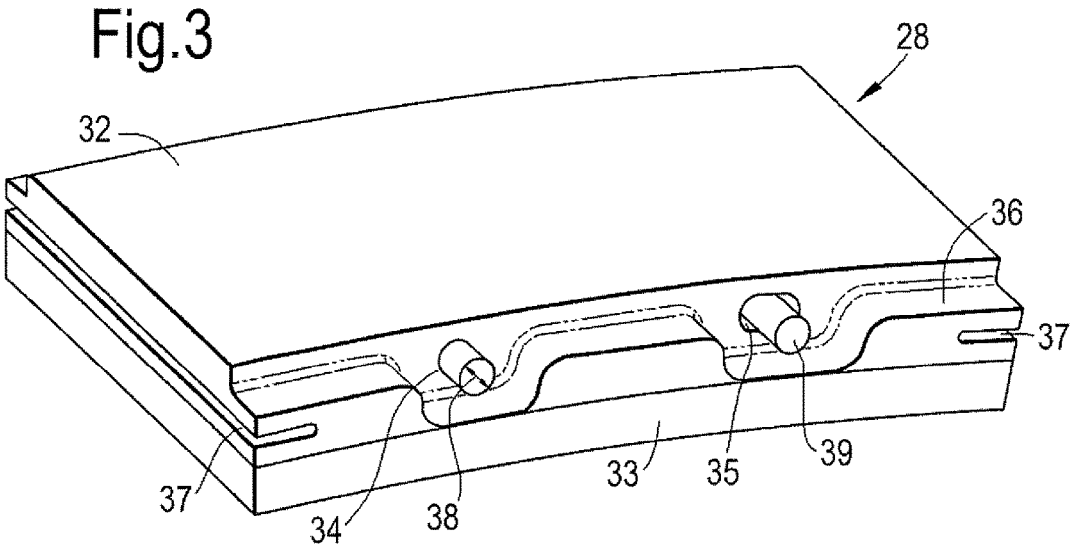
FIG. 3 shows schematically a perspective view of a seal segment.
Figure 4:
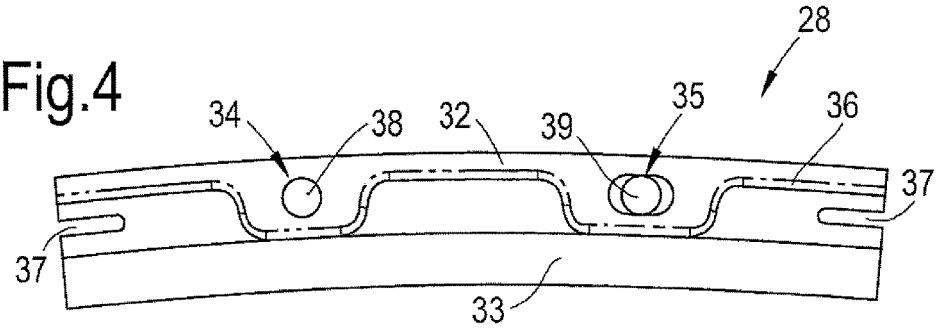
FIG. 4 shows schematically a front view of the seal segment of FIG. 3.

FIG. 3 shows schematically a perspective view of one of the seal segments 28, and FIG. 4 shows schematically a front view of the segment 28. The segment 28 has a substantially plate-like, rectangular shape. The radially outer part 32 of the segment 28 is formed from continuous fibre reinforced ceramic matrix composite. The radially inner part 33 of the segment 28 is formed by an abradable coating comprising hollow ceramic spheres in a ceramic matrix, as disclosed in EP 0751104. The abradable coating also acts as a thermal barrier coating.

A first passageway, in the form of a first through-hole 34 of circular cross-section, extends through the radially outer part 32 from the front to the rear face of the segment 28. A second passageway, in the form of a second through-hole 35 of racetrack-shaped cross-section, and circumferentially spaced from the first through-hole 34, also extends through the radially outer part 32 from the front to the rear face of the segment 28. The front and rear faces both contain a shelf 36 which divides the respective faces between a radially outer recessed portion and a radially inner projecting portion. Each shelf 36 runs between circumferentially opposing side faces of the segment 28, making radially inward detours to position the entrances of the through-hole 34, 35 at the radially outer recessed portions of the front and rear faces. The circumferentially opposing side faces of the segment 28 both contain a respective slot 37 which extends in the fore and aft direction of the engine and, in the assembled shroud ring 27, contains a respective strip seal (not shown) for sealing the seal segment 27 to a circumferentially adjacent seal segment. However, other approaches may be adopted for sealing adjacent seal segments.

The first 34 and the second 35 through-holes respectively contain first 38 and second 39 cylindrical metallic support bars, of circular cross-section. The support bars 38, 39 project from the entrances of the through holes 34, 35 to be approximately level at their ends with the radially inner projecting portion of the front and rear faces. To mount the seal segment 28 to the backing plate 29, the seal segment is offered to the plate 29 so that the front and rear shelves 36 engage complimentary surfaces formed at the radially inner ends of the front and rear flanges of the plate 29. When thus-engaged, the through holes 34, 35 are aligned with matching holes formed in the flanges, and the support bars 38, 39 are inserted through the through-holes 34, 35 and the matching holes to attach the segment 28 to the plate 29.

In the as-built condition, the support bars 38, 39 are a clearance fit in the through-holes 34, 35, but at operating conditions differential thermal expansion between the metal of the support bars 38, 39 and the ceramic matrix composite of the seal segment 28 changes this to a light interference fit. The corresponding cross-sectional shapes of the first support bar 38 and the first through-hole 34 fixes the segment 28 relative to the first support bar 38 (and hence to the backing plate 29) in the radial and circumferential directions. In contrast, the circular cross-sectional shape of the second support bar 39 and the racetrack cross-sectional shape of the second through-hole 34 fixes the segment 28 relative to the second support bar 39 in the radial direction, but allows relative movement (even under a light interference fit) of the segment 28 and the second support bar 39 in the circumferential direction.

Differential thermal mismatch of the seal segment 28 relative to the backing plate 29 can thus be accommodated. Differential circumferential mismatch produces the relative circumferential movement of the segment 28 and the second support bar 39, which in turn causes variation in the gaps between adjacent segments. However, the strip seals contained in the slots 37 prevent hot gas from penetrating between segments 28 when the gaps grow. Differential axial mismatch causes some relative axial interfacial slippage between the segment 28 and the support bars 38, 39 and/or between the support bars 38, 39 and the plate 29, but does not compromise the attachment of the segment 28 to the plate 29.

The through-hole and support bar attachment technique avoids the use of sharp geometries, such as hooks or internal corners, which can cause undesirable stress concentrations in ceramics.

Advantageously, the plate-like, rectangular shape of the seal segment 28 is compatible with conventional continuous fibre reinforced ceramic matrix composite production techniques. More particularly, the radially outer part 32 of the segment 28 can be produced by stacking successive plys which extend parallel to the radially inward facing surface of the segment 28. Each ply can be formed from a cloth of woven continuous reinforcement. As each ply is stacked it is covered in a slurry containing a binder, water and ceramic. Alternatively, the plys may be pre-impregnated with the slurry. The stacked plys are pressed to remove excess slurry, and heated to drive off moisture which allows the binder to form a self-supporting green form. The green is then heated in a furnace to sinter the ceramic particles to form the surrounding matrix. A lightly curved or straight-sided block can readily be formed in this way. The through-holes 34, 35, shelves 36 and slots 37 can be produced by subsequent machining.

By way of example, the reinforcement fibres can be Nextel720™ and/or Nextel610™ alumina silicate fibres available from 3M, and the ceramic particles can be alumina particles or a mixture of alumina and silicate particles. These are examples of Ox/Ox ceramic matrix composite materials. Another option, however, is to form the seal segment from a SiC/SiC ceramic matrix composite material, having a silicon carbide based matrix and silicon carbide based reinforcement fibres. A SiC/SiC seal segment can be manufactured by CVI (Chemical vapour infiltration) and/or MI (melt infiltration).

The radially inner part 33 of the seal segment 28 can be moulded directly on the radially outer part 32 or cast and fired separately to the required shape (and typically also machined) and then glued to the radially outer part 32, as discussed in EP 0751104.

As well as being simple to produce, by virtue of its shape the seal segment 28 is also relatively simple to analyse mechanically. This is advantageous as it allows suitable testing arrangements to be developed for the material of the segment 28 which can avoid expensive engine testing. For example, the main loadings on the segment 28 are reactive line loads where the segment 28 contacts the radially outermost parts of the support bars 38, 39, a pressure load over the radially outer surface of the segment caused by the differential pressure between the cooling air in the space 30 and the hot gas in the gas passage 26, and a thermal load caused by a thermal gradient across the thickness of the segment 28. This loading regime can be simulated in relatively simple bending tests.

Figure 5:
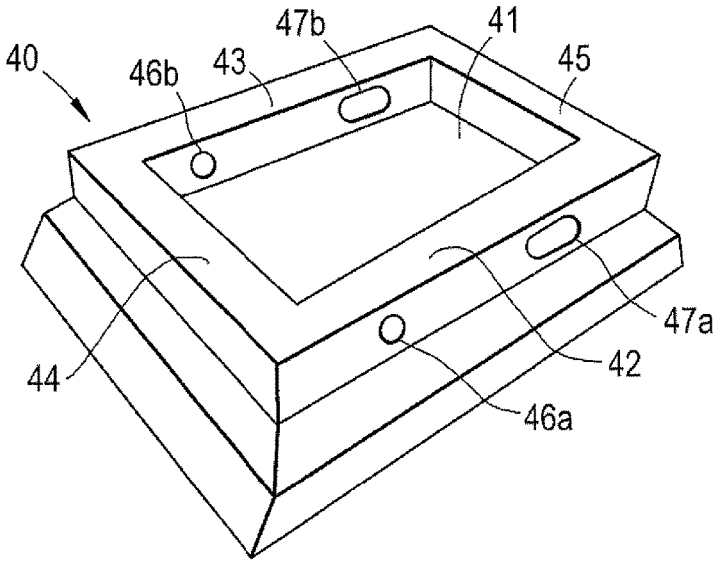
FIG. 5 shows schematically a perspective view of a further seal segment.

FIG. 5 shows schematically a perspective view of a seal segment 40 having a "bath tub" shape. The segment 40 has a substantially plate-like, rectangular shape base 41 which, in use, is located adjacent the rotor. Front 42, rear 43 and side 44, 45 walls extend radially outwardly from the edges of the base 41. The segment 40 can again be formed from continuous fibre reinforced ceramic matrix composite, and an abradable coating, e.g. of the type disclosed in EP 0751104, may be formed on the radially inner surface of the base 40.

A first passageway, in the form of a first pair of aligned through-holes 46*a*, 46*b* of circular cross-section in the front 42 and rear 43 walls, extends from the front to the rear face of the segment 40. A second passageway, in the form of a second pair of aligned through-holes 47*a*, 47*b* of racetrack-shaped cross-section, also extends from the front to the rear face of the segment 40. The second passageway is circumferentially spaced from the first passageway. In use, both passageways receive circular support bars (not shown), the supports bars projecting from the through-holes for mounting to a backing plate (not shown). The segment 40 is fixed relative to the support bar in the first passageway in the radial and circumferential directions, and the segment 40 is fixed relative to the support bar in the second passageway in the radial direction, but can move in the circumferential direction relative to the support bar in the second passageway.

While the invention has been described in conjunction with the exemplary embodiments described above, many equivalent modifications and variations will be apparent to those skilled in the art when given this disclosure. For example, the support bars 38, 39 could be formed of monolithic ceramic or of ceramic matrix composite. Such bars can have improved thermal expansion coefficient matching with the ceramic matrix composite of the segment 28. In another example, the support bars of the seal segment of FIG. 5 could be attached to the backing plate between the front 42 and rear 43 walls, e.g. by a clevis bar arrangement in the manner of US 2007/0031258. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A seal segment for a shroud ring of a rotor of a gas turbine engine having a principal axis of rotation, the seal segment being positioned, in use, radially adjacent the rotor, the seal segment comprising:

first and second circumferentially spaced passageways each of which extends in fore and aft directions in relation to the principal axis, a first support bar within the first passageway, and a second support bar within the second passageway, the first and second support bars each being mountable to complementary formations provided by a casing of the engine, wherein the first passageway is configured such that the seal segment is fixed relative to the first support bar in the radial and circumferential directions in relation to the principal axis, and the second passageway is configured such that the seal segment is fixed relative to the second support bar in the radial direction but allows relative movement of the seal segment and the second support bar in the circumferential direction, the first and second support bars each project from a front face and a rear face of the seal segment for mounting thereat to the complementary formations provided by the casing, and ends of the first and second support bars are received within recessed portions in at least one of the front face and the rear face of the seal segment.

2. A seal segment according to claim 1, wherein the ends of the support bars are level with the front face and rear face.

3. A seal segment according to claim 1, wherein the seal segment is formed of ceramic.

4. A seal segment according to claim 1, wherein the seal segment is formed of ceramic matrix composite.

5. A seal segment according to claim 1, wherein the seal segment is formed of continuous fibre reinforced ceramic matrix composite.

6. A seal segment according to claim 5, wherein reinforcing fibres of the continuous fibre reinforced ceramic matrix composite are contained in layered plys which extend parallel to a radially inward facing surface of the seal segment.

7. A seal segment according to claim 6, wherein the layered plys are radially outwards of the support bars and extend between the front face and rear face, and between the circumferentially opposing side faces.

8. A seal segment according to claim 1, wherein the seal segment has a substantially plate-like shape.

9. A seal segment according to claim 1, wherein an abradable ceramic coating forms a radially inward facing surface of the seal segment.

10. A seal segment according to claim 1, wherein the first and second support bars are circular cross-section, cylindrical rods, the first passageway has a correspondingly circular cross-section, and the second passageway has a racetrack-shaped cross-section which allows the relative movement of the seal segment and the second support bar in the circumferential direction.

11. A seal segment according to claim 1, further comprising circumferentially opposing side faces, each side face providing a respective slot which extends in the fore and aft direction and which, in the shroud ring, contains a respective strip seal for sealing the seal segment to a circumferentially adjacent seal segment.

12. A shroud ring of a rotor of a gas turbine engine, the shroud ring including an annular array of seal segments of claim 1.

13. A gas turbine engine having the shroud ring of claim 12.

14. A seal segment according to claim 1, wherein the front face and the rear face both contain a shelf which divides the respective faces between the recessed portion and a radially inner projecting portion.

15. A seal segment according to claim 14, wherein the shelf extends between circumferentially opposing side faces of the segment.

* * * * *